United States Patent [19]

Ruf

[11] Patent Number: 4,751,917

[45] Date of Patent: Jun. 21, 1988

[54] MOTION EXERCISER

[75] Inventor: Hermann Ruf, Darmstadt-Griesheim, Fed. Rep. of Germany

[73] Assignee: Heinz BAHR, Lautertal, Fed. Rep. of Germany

[21] Appl. No.: 874,222

[22] Filed: Jun. 13, 1986

[30] Foreign Application Priority Data

Jun. 14, 1985 [DE] Fed. Rep. of Germany ..... 3521470

[51] Int. Cl.[4] ..... A61H 1/02

[52] U.S. Cl. ..... 128/25 R; 128/25 B; 272/DIG. 5

[58] Field of Search ..... 128/25 R, 25 B, 80 R, 128/75; 272/141, 135, DIG. 5

[56] References Cited

U.S. PATENT DOCUMENTS

| | | | |
|---|---|---|---|
| 3,887,180 | 6/1975 | Berman | 272/141 |
| 4,323,060 | 4/1982 | Pecheux | 128/25 R |
| 4,492,222 | 1/1985 | Hajianpour | 128/25 R |
| 4,549,534 | 10/1985 | Zagorshi et al. | 128/25 R |
| 4,558,692 | 12/1985 | Greiner | 128/25 R |
| 4,566,440 | 1/1986 | Berner et al. | 128/25 R |
| 4,603,687 | 8/1986 | Greenwood | 128/25 R |
| 4,637,379 | 1/1987 | Saringer | 128/25 R |

*Primary Examiner*—Richard J. Apley
*Assistant Examiner*—J. Welsh
*Attorney, Agent, or Firm*—Karl F. Ross; Herbert Dubno

[57] ABSTRACT

A motion exerciser for the lower leg of a patient engages only the lower leg and has a tray receiving the calf of the lower leg connected by describing elements to a frame which is inclined upwardly away from the patient. A motor-driven carrying element is reciprocatable along the tray and is pivotally connected to the lower leg support at whose opposite end from the tray a footrest is provided which can be moved back and forth on the lower leg support against the force of a pair of springs. A display is provided for the force generated against the footrest.

10 Claims, 3 Drawing Sheets

MOTION EXERCISER

FIELD OF THE INVENTION

The present invention relates to a motor-driven motion exerciser to treat and strengthen the lower extremities including the hip joint. The motion exerciser consisting of an inclined substructure and a lower leg support having a foot rest, the latter being provided such as to be movable back and forth via a carrying element to achieve passive bending and stretching of the leg.

BACKGROUND OF THE INVENTION

Motion exercisers of this type permit continuous movement of the knee and the hip joints without exposing the leg to any weight-bearing load, a fact which can accelerate healing. The passive motion avoids stiffening of the joints during prolonged confinement to bed rest.

Motion exercisers already known consist of an inclined substructure, of a carrying element preferably driven by a motor, and a lower leg support incorporating a foot rest. These exercisers can only be used while the patient is awake, since lifting from the stretched position into the bent position is effected via the thigh, that means, by the entire leg forcing the patient to bend the knee himself or herself. However, this capability is not met with postoperative and with seriously ill patients.

It has however been stated that it is favorable to start with passive motion immediately following surgery and to effect kinesitherapy as far as possible continuously to prevent stiffening, to promote blood supply, and to mobilize healing tendencies. The possibility of immediate postoperative application, however is not realized by the earlier motion exercisers since such equipment can only be used during the patient's absolute waking state. Maximum clinical application of motion exercisers relates to passive mobilization of the hip and knee joints. Up to now clinical after-treatment had a substantial disadvantage, because not only a passive but also an active training of the leg muscle is considered to be decisive to ensure blood supply and especially to avoid a rapidly growing inactivity atrophy of the musculature. It is the patient's additional active cooperation during his waking state, to an extent which depends upon the patient's healing progress, which results in a positive physiotherapeutic effect.

OBJECTS OF THE INVENTION

It is an object of the present invention to provide a motion exerciser which may be used both during a waking state or semiconscious state as well as during a sleeping phase.

It is consequently another object of the present invention to provide a motion exerciser which allows, in the presence of an uncomplicated application, even active mobilization, apart from a continuous passive motion.

SUMMARY OF THE INVENTION

According to the present invention a motion exerciser is provided which has, on the side facing the knee, a lower leg support with telescopic carrying elements which, in their final position with the leg stretched, determine such an angle with respect to the frame of the exerciser that the support will be guided into the upper position more rapidly than into the bending position, said angle being $\geqq 45°$.

According to the present invention the lower leg support consists of two transversally spaced bars, one ends of said bars being engaged in flanges arranged for swivelling movement at the carrying element to be displaced longitudinally, while the other ends are provided to be engaged in the lower leg tray. This tray is linked on either side to the telescopic carrying elements supported for swivelling movement on the substructure. The motor-driven carrying element to be displaceable forth and back in the longitudinal direction having a transversal guiding means between the transversally spaced bars of the frame, consists of two transversally spaced carrying elements. These carrying elements are connected via an axle provided transversally with respect to the moving direction, the flanges belonging to the lower leg support being supported on the axle and the axle bearing the foot rest either directly or indirectly.

The present invention, for active mobilization of the leg and hip area, displaces the foot rest in the longitudinal direction and executes displacement against the effect of springs in the direction of pressure and/or tension. For this purpose the foot rest, on the side not facing the foot, is directly or indirectly provided with carrying bars engaging in a guiding function into a case and at least one of these bars is connected with spring elements. In this case one of the carrying bars may be provided with springs in the direction of tension or pressure, while the other carrying bar may measure such pressure or tension in relation to the displacement of the carrying bar. Both carrying bars are, according to the present invention, arranged parallel with respect to each other in a case connected with the carrying element. Displacement of the carrying bar due to the pressure or tension exercised via the foot rest is measured by a suitable measuring facility and indicated by a measuring scale visible to the patient and preferably proved at the foot rest.

Treatment by means of the motion exerciser according to the present invention results in a reduction of postoperative pain and improvement of blood supply of the joints. Activation of the cartilage metabolism as well as a more rapid resorption of interarticulous haematomae are also a result of the treatment by means of the motion exerciser according to the present invention, apart from accelerated regaining of joint mobility.

SPECIFIC DESCRIPTION

Figure 1:
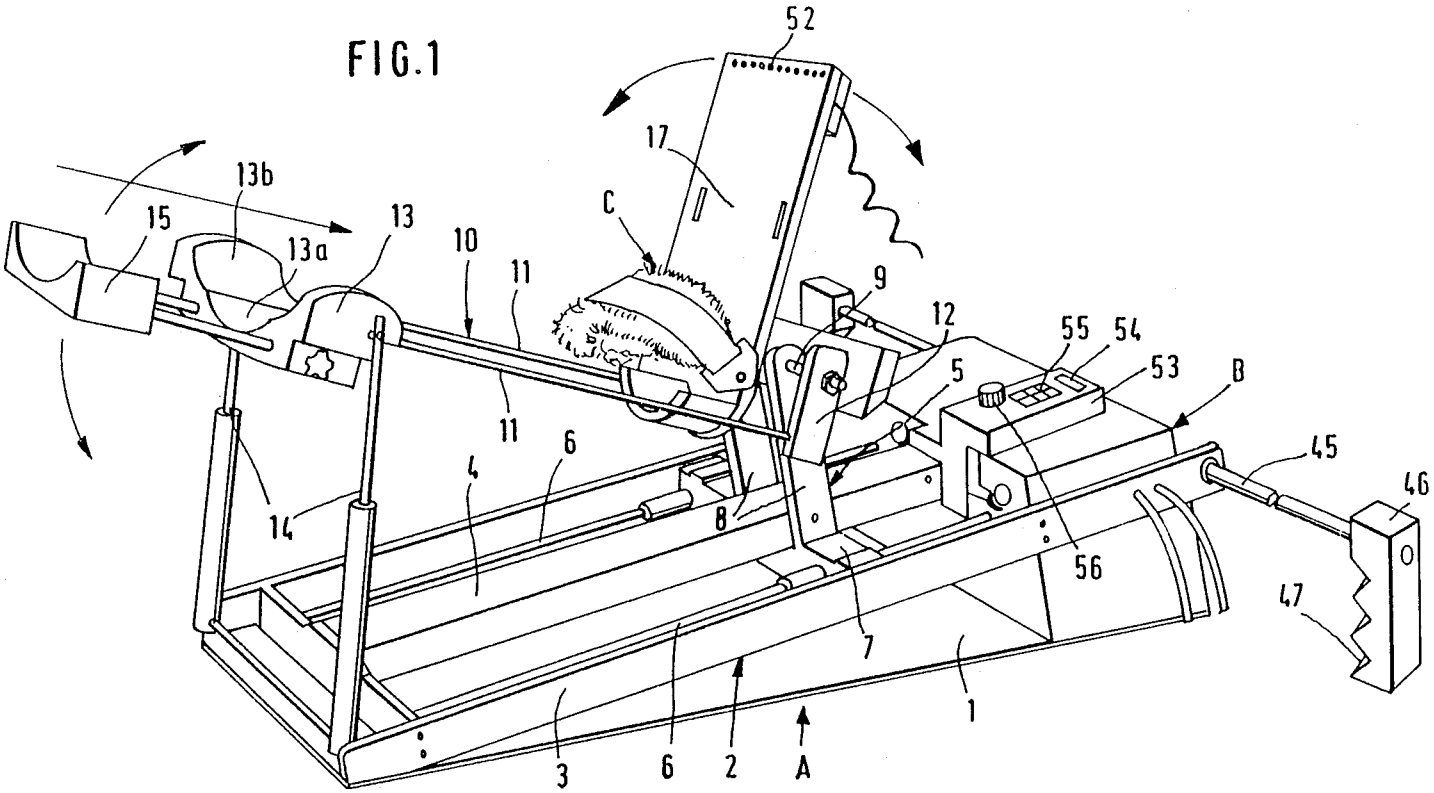
FIG. 1 is a perspective view of the entire motion exerciser in the bending position.

The leg motion exerciser according to the present invention comprises a substructure A, a case B incorporating the driving motor, the electronics, and the transformer, as well as the lower leg support and foot rest C including the corresponding carrying elements. The motion exerciser as shown in the drawing provides a motor drive acting on the lower leg support for passive movement of the leg, said movement being effected via an electronic control means and according to a predetermined motion rhythm (FIG. 1).

Substructure A has a foundation plate 1 to be placed on the bed surface or any other surface. A frame 2 is affixed to the plate 1 and 13 arranged in an upwardly inclined direction with respect to the foundation plate, the transversally spaced longitudinal bars 3 of the frame being parallel to the casing 4 of the motor spindle 44. The guiding bars for the carrying element 5 to be moved back and forth by rotation of the electric motor spindle are shown at 6.

The carrying element consists of the transversally spaced carriers 8 having guides 7 and an axle 9 transverse to the moving direction of the carriers 8.

Lower leg support 10 comprises two transversally spaced bars 11. The ends of bars 11 facing the foot rigidly engage in flanges 12. The flanges 12 are mounted to pivot about the axle 9. The other ends of the bars 11 are connected with the lower leg tray 13. The tray 13 is pivoted for swivelling movement on either side to telescopic carrying elements 14 provided on the substructure A.

The tray may be upholstered and supports the patient's calf. For adjustment to the patient's individual conditions a second compensation tray 15 which is also upholstered, may be provided. The tray 15 is adjustable with respect to the lower leg tray 13 in the direction of the lower leg support movement. The lower leg tray 13 has a trough of different radii of curvature. The radius of curvature, for instance, of the center part 13*a* is smaller than that of the outer part 13*b*.

As may be seen from FIG. 1 the lower leg support is provided with a foot rest 17 on which the foot is resting during the passive bending and stretching movement of the leg due to the reciprocating movement of the lower leg support.

The lower leg support 10, on the one hand, is connected to the carrying element 5 via the flanges 12 and the axle 9, and, on the other hand, is supported at the substructure A of the motion exerciser via the telescopic carrying elements 14 engaging at the lower leg tray 13. The second tray 15 serves for adjustment of the length of the patient's lower leg in order to permit support directly below his knee. The knee itself, however, remains free. The lower leg support is provided such that the lift is effected by means of the calf, while, after stretching, the lower leg support is moved upwards more rapidly than the carrying element 5 is moved backwards so that an automatic bending of the knee is effected even without the patient's cooperation. This is achieved by the fact that the angle defined between the telescopic carriers 14 and the plane of frame 2 amounts to not less than 45°. As a result, application of the motion exerciser is not limited to the patient's waking state, but the motion exerciser may also be used even during the patient's sleep for periods of time suggested by the physician to ensure continuous passive mobilization.

The foot rest 17 is supported so as to be displaceable with respect to the lower leg support 10 to the extent that a pressure or tension is exerted by the patient's foot on the sole plate. Consequently, in addition to the passive movement produced by the motor, a further active movement may be produced by the patient.

Figure 2:
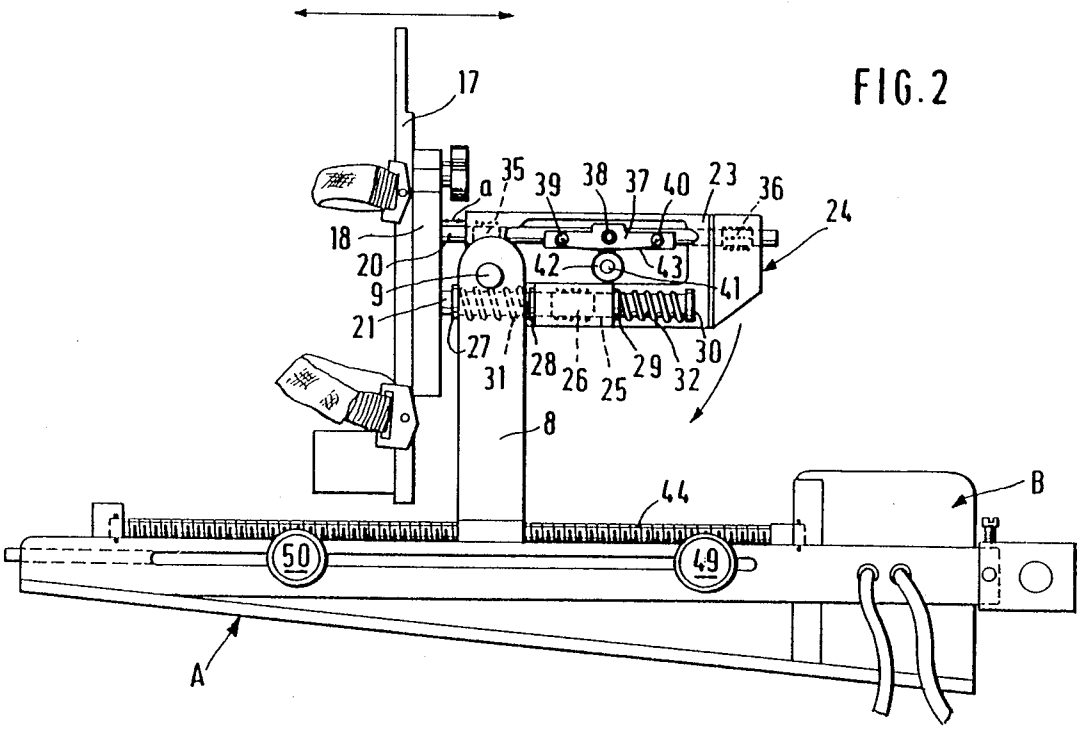
FIG. 2 is a partially sectional view of the motion exerciser without the lift equipment and lower leg support.

FIG. 2 is a lateral view of the motion exerciser without the lifting equipment, part of the exerciser being omitted for the purpose of better understanding. The sole plate of the foot rest 17 which is equipped with foot fixing belts, is provided with a pressure plate 18 permitting the sole plate to rotate thereon. The rigid plate 18 which cannot be turned, is provided with carrying bars 20, 21 for the foot rest 17. The carrying bars 20 and 21 extend into the case 24 and define a distance determining the length of displacement of the sole plate of the foot rest in the direction of said case 24, and are supported in the case 24. In the drawing the case wall facing the viewer has been broken away to reveal the contents of the case. The carrying bar 20 carries a measuring means. The force acting upon the sole plate and resisting displacement is applied via the carrying bar 21.

The carrying bar 21 which is positioned parallel to and below the carrying bar 20, is supported, approximately in the center, in the bore of a block 25 of the case 24 via a segmented bearing 26. On either side of the bearing 26, discs 27, 28 and 29, 30 are provided, in mutually spaced relationship to serve as supports for the coil springs 31 and 32 arranged between the discs 27 and 28 and the discs 29 and 30. The discs 27 and 30 are connected to the bar by pins or otherwise fixed to the same. The spring 31 acts upon the application of pressure to the sole plate while the spring 32 is pressed together upon tension on the sole plate 17. Practical experience has shown that the force of the spring 31 should be approximately 30 kgs and that of the spring 32 approximately 10 kgs.

The carrying bar 20 is also engaged in the case 24 and is supported in bores of the wall 23 of the case 24 preferably via thrust ball bearings 35 and 36. In the interior of the case at the center of the carrying bar 20 a device is provided for measurement of the movement of the sole plate 17. The measuring equipment consists of a thread on the bearing plate which is connected with the carrying bar 20 at 38. The two deflection pulleys 39 and 40 over which the thread 43 passes are mounted on the bearing plate and thus on the carrying bar 20, while a center pulley 42 (around which the thread 43 passes) consists of a sleeve connected with a potentiometer 41. The sleeve 42 rotates on the case 24.

With a relative movement of the bar 20 with respect to the case 24 in the case of pressure or tension acting on the foot rest the thread 43 is pulled by the deflection pulleys 39 and 40 in one direction or the other to rotate the sleeve 42 and the sleeve 42 is turned together with the potentiometer shaft 41. This rotation provides a measure of the displacement of the bar 20 and thus of the force exerted by the foot. The potentiometer connected to the potentiometer shaft 41 is incorporated into a circuit providing optical signals 52 at the upper end of the sole plate of the foot rest 17. According to pressure or tension a smaller or greater number of signals 52 are illuminated on the light chain. The patient will therefore be able to supervise his progress personally. The light chain may even be replaced by digital display.

Alternatively a rack can be located at the carrying bar 20, the rack meshing with a gear wheel which rotates together with the potentiometer shaft.

I can also provide the motion exerciser according to the present invention with an aditional potentiometer, preferably a rotary potentiometer, which is integrated into the control circuit of the motion exerciser and which is located between the axle 9 and a measuring sleeve to measure the bending in degrees. The bending degree is digitally recorded on the control panel 53 at 54.

The axle 9 of the carrying element 5 passes through bears the case 24 and thus the foot rest 17 via the carrying bars 20 and 21. When the leg is moved automatically, the case 24 and the foot rest 17 swing in the direction indicated by the arrow (FIG. 2).

Because of the continuous passive and even active mobilization generated by the device of the invention it is necessary for the motion exerciser to have a stationary place in the patient's bed and that, at any time, adjustment to any position of the patient may be effected to eliminate any disadvantage to the patient as, for example, becoming bedsore. As a further development of the motion exerciser it is therefore proposed to provide a unit at the front end to attach the same to the hospital bed. Said unit consists of a bar 45 arranged transversally with respect to the moving direction and having holding or clamping pieces 46 arrange on either side in a vertical direction, said pieces being adapted to be displaced and swivelled on said bar. The clamping pieces 46 are provided with several wedge-shaped recesses 47 serving to receive the cross bars at the foot of the bed. Depending on the position in which the exerciser is to be attached to the bed, either straight or inclined, coordination of the recess and the cross bars on either side of the bed will be effected. Various positions of attachment of the motion exerciser for any usual type of hospital bed and for hip abductions of 10° to 15° are thus possible.

Control of the motion exerciser is effected electronically and is subject to a predetermined program according to the individual needs of the patient. Programming is effected at the control panel 53 and 55. First, the leg is positioned in its stretched position on the lower leg support, the exerciser is switched on, and the desired stretching of the leg will be determined as the initial position. This position is specified as zero or initial point. Then the position of the lower leg support will also be fixed at the desired bending degree, and the motion exerciser may be started. The most efficient speed of the lower leg support may also be selected by means of the knob 56.

Figure 3:
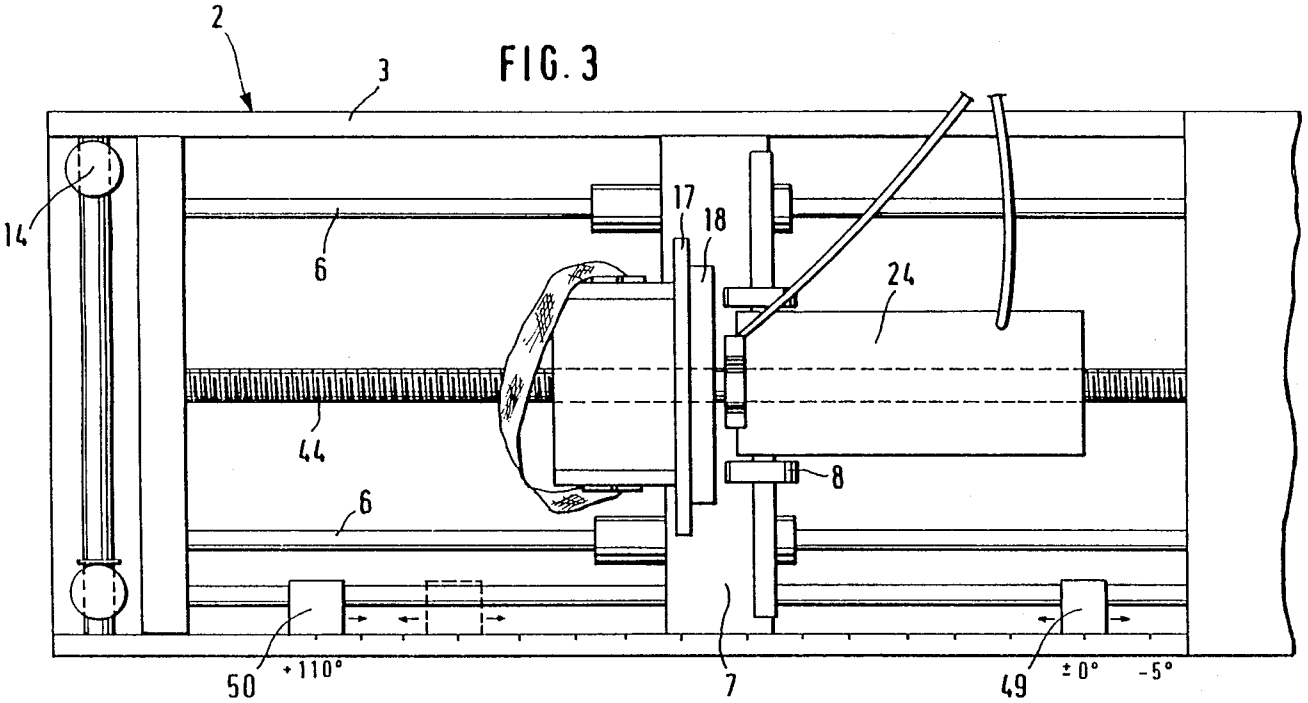
FIG. 3 is a top view of the motion exerciser without the lift equipment.

FIG. 3 is a top view of the motion exerciser according to the present invention without the lifting unit and having slightly altered features as compared with the embodiment of FIG. 1. The electronic control has been replaced by a mechanical adjusting means for adjustment of the stops 49 and 50 according to individual conditions.

In summarizing it will have to be emphasized that by means of the motion exerciser according to the present invention, notwithstanding the continuous passive movement, even an active movement of the leg with increasing controllable loads may be used, thereby increasing the efficiency of the exerciser. Omission of the thigh support which is a usual feature of embodiments already known, in connection with the construction of the lower leg support according to the present invention also permits greater stretching of the leg and a compulsory lift via the calf, a fact which offers great relief to the patient who is subject to heavy stress anyhow, due to automatic leg guidance. Another advantage of the motion exerciser according to the present invention is its simple and compact construction.

What is claimed is:

1. A lower-leg exerciser, comprising:

a base adapted to rest upon a surface receiving a patient whose lower leg is to be exercised;

a frame on said base inclined upwardly therefrom from a proximal end of said frame to a distal end thereof in a direction in which the lower leg extends away from the torso of the patient;

a carrying element extending upwardly from said frame and guided thereon for movement between said ends alternately in a direction of one and the other of said ends;

drive means including a motor of said frame coupled with said carrying element for imparting said movement thereto;

an elongated lower-leg support pivotally connected at a transverse axis at one end to said carrying element and having:

a footrest mounted on said lower-leg support for displacement thereon transversely to said axis, resilient means on said lower leg support resisting said displacement of said footrest on said lower-leg support, and at least one tray at an opposite end of said lower-leg support forming an upper calf support for the lower leg whereby the leg of the patient is only engaged at the lower leg thereof by the exerciser; and telescoping elements pivotally connected to said frame at said proximal end and pivotally connected to said lower-leg support at said opposite end thereof and inclined at an angle of at least 45 degrees to said frame when said carrying element is at its point most distal from the proximal edge of the frame, which is when said leg of said patient is most extended that, upon each movement of said carrying element toward said proximal edge, the tray is raised more rapidly than said carrying element is moved towards the proximal edge

2. The lower-leg exerciser defined in claim 1, further comprising clamping means at said distal end of said frame engageable with a bed forming said surface receiving said patient.

3. The lower-leg exerciser defined in claim 1 wherein said lower-leg support comprises two transversely spaced bars, said bars being rigidly connected to respective flanges at said one end of said lower-leg support, said flanges being pivotally connected to said carrying element at said axis, said telescoping elements being pivotally connected to said lower-leg support at said tray.

4. The lower-leg exerciser defined in claim 1 wherein said footrest is provided with a pair of carrying bars extending into a case pivotable about said axis and guiding said footrest for movement relative to said case, one of said carrying bars being provided with a pair of springs forming said resilient means and received in said case, one of said springs being stressed upon movement of said footrest toward said case and the other of said springs being stressed upon movement of said footrest away from said case, the other of said carrying bars being provided with indicating means for measuring a stress developed by said resilient means.

5. The lower-leg exerciser defined in claim 4 wherein said carrying bars are parallel to one another.

6. The lower-leg exerciser defined in claim 5 wherein within said case said one of said bars is engaged by a segmented bearing on said case, flanked by said springs.

7. The lower-leg exerciser defined in claim 5 wherein said other of said bars is supported in said case at opposite ends thereof in respective ball bearings.

8. The lower-leg exerciser defined in claim 7 wherein said indicating means includes a member carried by said other of said bars and provided with a potentiometer driven upon movement of said other of said bars relative to said case and connected to a display provided on said footrest.

9. The lower-leg exerciser defined in claim 1, further comprising a compensating tray mounted for longitudinal adjustment on the first-mentioned tray.

10. The lower-leg exerciser defined in claim 1 wherein said tray is formed with troughs having different radii of curvature.

* * * * *